United States Patent [19]

Chica

[11] 4,378,082

[45] Mar. 29, 1983

[54] QUICK RELEASE HOLSTER

[75] Inventor: Quentin J. Chica, Springfield, Mass.

[73] Assignee: Bangor Punta Corporation, Springfield, Mass.

[21] Appl. No.: 183,741

[22] Filed: Oct. 3, 1980

Related U.S. Application Data

[63] Continuation-in-part of Ser. No. 83,342, Oct. 10, 1979, abandoned, which is a continuation of Ser. No. 881,829, Feb. 27, 1978, abandoned.

[51] Int. Cl.[3] ..... F41C 33/02

[52] U.S. Cl. ..... 224/243; 224/193; 224/911

[58] Field of Search ..... 224/243, 192, 198, 250, 224/911, 912

[56] References Cited

U.S. PATENT DOCUMENTS

| | | | |
|---|---|---|---|
| 1,635,984 | 7/1927 | Corriston | 224/244 |
| 2,297,008 | 9/1942 | McMillan | 224/243 |
| 2,917,213 | 12/1959 | Bucheimer et al. | 224/911 |
| 3,200,021 | 8/1965 | Clark | 224/911 |
| 4,035,902 | 7/1977 | Bianchi et al. | 224/193 X |
| 4,076,156 | 2/1978 | Katz | 224/243 |
| 4,218,000 | 8/1980 | Mixson | 224/911 |
| 4,270,680 | 6/1981 | Bianchi | 224/193 |

*Primary Examiner*—Steven M. Pollard

*Attorney, Agent, or Firm*—LeBlanc, Nolan, Shur & Nies

[57] ABSTRACT

A holster for holding a handgun having a safety strap integrated with a quick release mechanism to hold the handgun in place until released by the user. The strap extends from an exposed portion of the holster over a part of the handgun and cooperates with a complementary member and the release mechanism integrated therewith for releasing the strap from the complementary member thereby allowing the gun to be withdrawn. This release mechanism is located sufficiently within the outer dimensions of the handgun and the holster to impede substantially inadvertent actuation.

4 Claims, 9 Drawing Figures

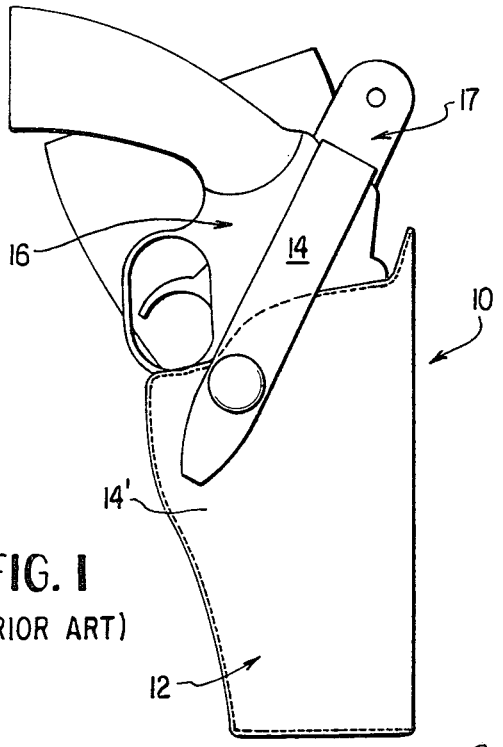
FIG. 1
(PRIOR ART)
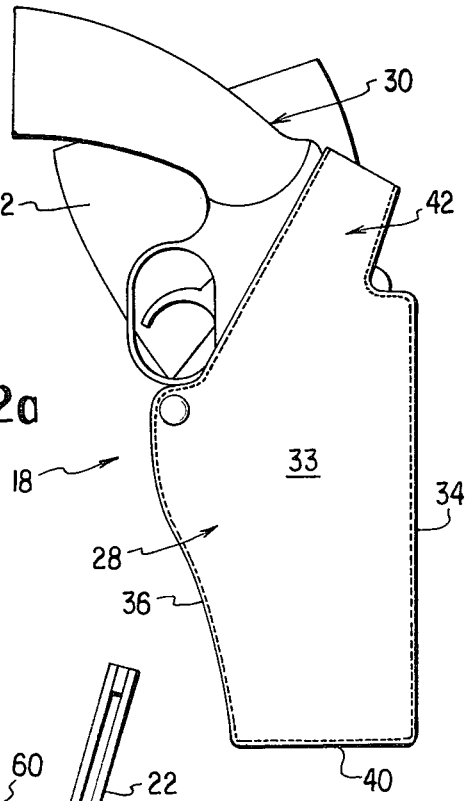
FIG. 2a
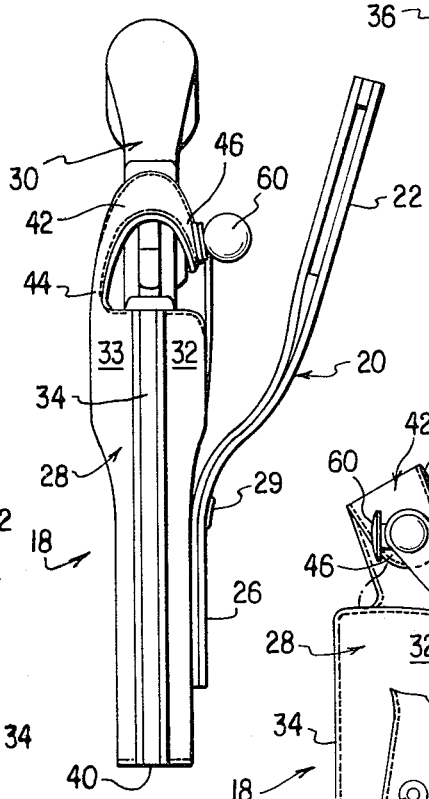
FIG. 3
FIG. 2b
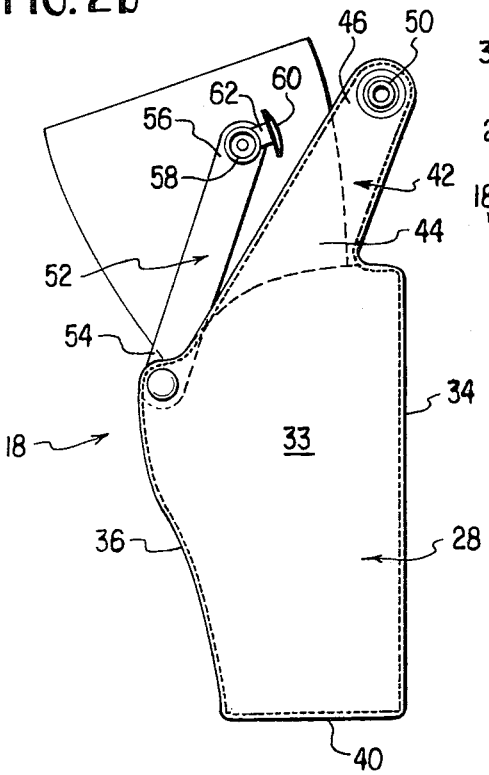
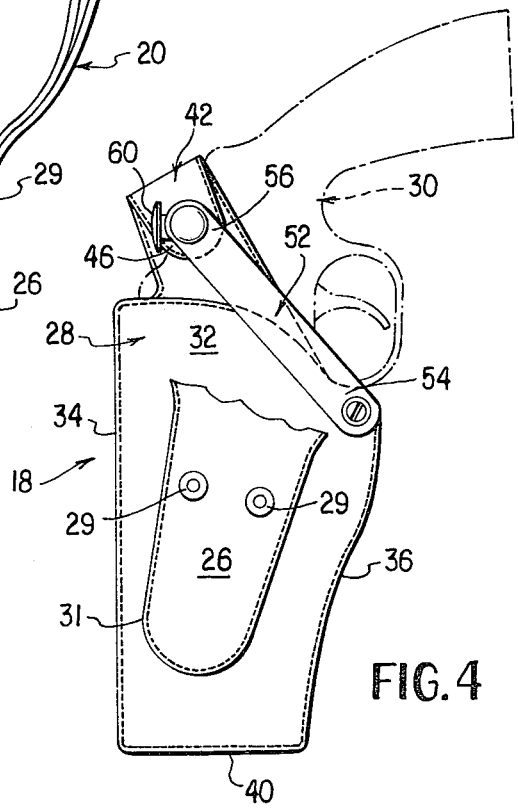
FIG. 4

QUICK RELEASE HOLSTER

This application is a continuation-in-part of U.S. patent application Ser. No. 083,342, filed Oct. 10, 1979, now abandoned which application was a continuation of U.S. patent application Ser. No. 881,829, filed Feb. 27, 1978 now abandoned.

BACKGROUND OF THE INVENTION

In many holsters for handguns, there has been employed a safety strap which holds the handgun in place to prevent the handgun from inadvertently falling out until the strap is released by the user. Some of these holsters further use a quick release mechanism to disengage the safety strap quickly when the handgun must be withdrawn particularly in the case of an emergency. This mechanism has typically involved a paddle member which is made of leather having one end attached to the holster and the other end extending upwardly therefrom for actuation. One part of the snap fastener member is carried by the paddle which snaps into another part of a snap fastener member carried by the safety strap. When the gun is secured in place, the user simply presses the paddle with his thumb as he reaches for the handle of the gun to break the snap fastener allowing the gun to be withdrawn. See for example U.S. Pat. Nos. 2,917,293 and 4,035,902.

The problem with the use of a paddle is that it extends well beyond the periphery of the gun when it is carried in the holster. As a result, it can be inadvertently pressed by movement of the arm or brushing up against other objects when the gun is carried on the belt of the user. In addition, because the paddle member is made of leather, it loses its rigidity upon repeated actuation. Thus, over a period of time, the leather becomes so flexible that pressing of the paddle by the user will not break the snap fastener member impeding withdrawal of the handgun with the speed desired.

In an early effort to solve this problem a metal latch mechanism was provided on the holster which engaged the trigger guard of the weapon. A biased latch was provided which released the weapon when rotated inwardly toward the wearer. See U.S. Pat. No. 1,635,984. While this device secured the weapon in the holster, release required holding the latch in an open position, against the spring while the weapon was withdrawn from the holster. Release then required an awkward movement which could impede withdrawl of the weapon from the holster.

A further attempt to provide a holster with a releasable safety strap utilized a strap which extended from a swivel connection on the pocket, over the weapon as in U.S. Pat. No. 4,035,902. However, the releasable end of the strap was secured by snap fasteners to the back of the holster adjacent the wearer. See U.S. Pat. No. 4,076,156. While this device also secured the weapon in the holster, withdrawal thereof required a separate movement to release the snap fasteners, and therefore, rapid withdrawal of the weapon was similarly impeded.

Accordingly, there remains a need to provide a holster which will secure the weapon therein against inadvertent withdrawal or withdrawal by persons other than the wearer, but which will permit a rapid and unimpeded withdrawal by the wearer. A release actuator for the safety mechanism then is needed which will be actuated by the movement of the wearer to withdraw the weapon from its holster.

It is an object of the invention described hereinafter to overcome many of the problems which have plagued quick-release safety straps when used with holsters. More specifically, it is an object to provide a release mechanism which is located relative to the handgun when it is secured in the holster so that it cannot be inadvertently actuated.

It is further an object to provide a quick-release system which will not deteriorate over time insuring that the release mechanism will work properly even upon repeated actuation.

These and other objects will be more apparent from the detailed description of the preferred embodiments and the claims which follow hereinafter.

SUMMARY OF THE INVENTION

Generally, the invention relates to an upwardly opening holster for holding a handgun having a pocket portion for receiving the handgun secured to a belt receiving member for attaching the holster to a belt worn by the user. The pocket portion is generally defined by two sides, an exposed side portion and a back side portion. A safety strap extends from the exposed portion for looping over a part of the handgun when it is placed in the pocket and cooperating with a complementary means to releasably secure the handgun in place. For this purpose, the safety strap carries at one end a first part of a releasable securing member which cooperates with a second part of the releasable securing member carried by the complementary means. Actuator means is integraded with the two parts of the releasable securing member for releasing it upon applied pressure from a finger of the user. Only in a rearward direction coincident with the motion required to withdraw the handgun from the holster. The actuator means is located between the handgun and the belt receiving member of the holster to prevent inadvertent actuation.

BRIEF DESCRIPTION OF THE DRAWINGS

FIG. 1 is an elevation of the holster which characterizes the prior art.

FIG. 2A is an elevation of the holster of this invention with the snap fastener members in a closed position.

FIG. 2B is an elevation of the holster with the snap fastener member in an open position.

FIG. 3 is a front view of the holster with a handgun being carried therein with the snap fastener in a closed position illustrating one embodiment of the actuator.

FIG. 4 is a side view of the holster of FIG. 3 with a portion cut away.

DETAILED DESCRIPTION OF THE PREFERRED EMBODIMENT

Figure 5:
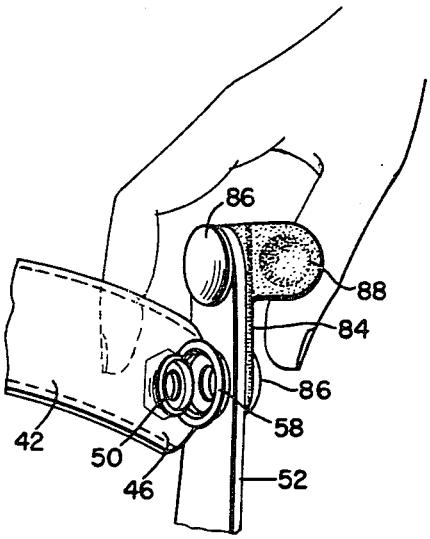
FIG. 5 is a fragmentary view of the one-way fastener of this invention illustrating a closing movement.

In referring to FIG. 1, there is shown an example of the prior art quick release holster. The holster 10 includes a pocket portion 12 in which the handgun is normally carried. The front part 14' of the pocket part 12 has a safety strap 14 which extends over the hammer portion of the pistol 16 releasably secured to a paddle 17 which is fastened to the side portion of the holster behind the pistol. The strap carries one part of a snap fastener which cooperates with the other complementary part of the snap fastener carried by the paddle. Thus, when the handgun 16 is placed within the pocket portion 12 of the holster 10, the strap 14 is simply hooked over the hammer portion of the handgun and snapped to the paddle 17. To release the gun, the paddle 17 is simply pressed with the thumb in a direction away from the safety strap 14 thus opening the snap fastener mechanism.

In this way, the gun can be quickly withdrawn as desired by the user. But as can be seen from FIG. 1, the paddle 17 extends well beyond the peripheral dimensions of the handgun 16 being readily exposed for inadvertent actuation. As a result, if the user wearing such a holster accidentally brushes against the paddle 17 or if other people or objects bump against the paddle 17, the snap fastener may be inadvertently opened allowing the gun to fall out of the holster, or to be removed therefrom by a person other than the wearer.

Referring now to FIGS. 2A, 2B, 3 and 4, it can be seen that in this embodiment of the invention, the problems which have plagued the use of the paddle described above are overcome. More specifically, the holster 18 includes a belt receiving member 20 which is a portion of the holster 18 normally worn against the body of the user. This belt member 20 includes an upper portion 22 which defines a belt hole on which the holster 18 can be worn. As can be seen in FIGS. 3 and 4, a lower portion 26 of the belt member 20 is secured to the pocket 28 by two rivots 29 as well as stitching 31 about the edges. This pocket 28 includes a backside 32, the upper part of which is displaced outwardly from the upper portion 22 of the belt member 20 and an exposed side 33 stitched to the backside 32 to form the pocket 28 with an open top 38 for receiving the handgun 30. These sides 32, 33 are stitched to each other along rear edge 36 and front portion 34; the bottom portion 40 may be open or closed depending on the size of the handgun being carried.

The pocket 12 includes releasable securing mechanism which holds the handgun in place until the mechanism is actuated by the user. Specifically, a safety strap 42 extends from the exposed side 32 for looping over the hammer portion of the handgun 30 when it is carried in the pocket 28. The strap 42 has one end 44 secured to the exposed side 32 and a distal end 46 which carries the male part 50 of a snap fastener member. A rear strap or "paddle" 52 has a secured end 54 which is secured to the backside 32 of the holster 18 well below the outer peripheral dimensions of the handgun 30 when it is placed within the holster 18. The other end of the paddle 52 is a snap end 56 which carries the female part 58 of the snap fastener member. With this configuration, the safety strap can be looped over the hammer portion of the gun and the male part 50 snapped into the female part 58 of the snap fastener to releasably lock the handgun 30 in place.

The snap end 54 further comprises a release button 60 which extends transversely from the snap end 56 for easy access and actuation by the thumb when the user grabs the handle of the handgun when it is locked in the holster. Extending from this release button 60 is a metal plate 62 (best shown in FIG. 2B) which is secured to the snap end 56 of the paddle 52 to give that portion of the paddle sufficient rigidity for actuating the button 60. The paddle 52 itself is made of polyurethane which is a semirigid material sufficiently flexible so that pressing of the button by the thumb will break the snap fastener allowing the handgun to be withdrawn and yet sufficiently rigid that repeated actuation of this release mechanism will not cause the paddle to deteriorate in flexibility. With this material, a repeatability of operation is achieved without deterioration over a long period of time which could not be accomplished by the leather paddles typically used.

It should be noted that length of the paddle 52 is such that no part of the paddle 52 or the snap fastener member 50, 58, extends beyond the outer perimeter of dimensions defined by the handgun while it is carried within the pocket portion of the holster. Thus, as can be seen in FIG. 2, although the release mechanism is essentially hidden from view, it it readily accessible for operation by the user. As a result, the safety strap 42 will not be inadvertently released by simply brushing against the paddle or by other object or people bumping into the paddle. In other words, the release mechanism is protected from actuation by the outer dimensions of the handgun 30 and the holster 18 as well. The only way it can be actuated is by actually reaching in between the handgun 30 and the holster 18 to press the button 60, and breaking the snap fastener 50, 56. In this manner, a much more safe and efficient operation of the release mechanism for the safety strap of a holster is achieved.

Figure 6:
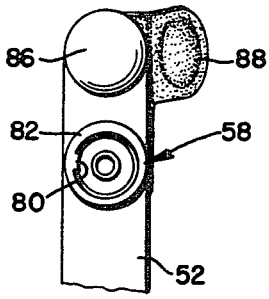
FIG. 6 is a fragmentary view of the female portion of the fastener of FIG. 5.

With attention to FIGS. 5 and 6, snap fasteners 50, 58 are preferrably one-way fasteners. Female member 58 is provided with an internal lip 80 on rim 82. Lip 80 is located on the rear portion thereof so that engagement of the male member 50 therewith can only occur if the adjacent portion thereof is first inserted in member 58 and the fastener closed with the motion shown in FIG. 5, i.e., rear-to-front. Similarly, the fasteners can only be disengaged by separating that portion of the male member 50 from rim 82 opposite lip 80, first, by a front-to-rear movement.

The actuator furthermore consists of a metal support 84 affixed to the distal portion of paddle 52 by rivots 86. An integral button member 88 extends laterally from plate 84 for engagement with the wearer's thumb as shown in FIGS. 5 and 8 to engage a disengage snap fasteners 50 and 58 by movement between the handgun and the belt member 20.

It should be noted that the embodiment of FIGS. 2A–4 and the embodiment of FIGS. 5–8 differ in the configuration of the actuator button. In the former, button 60 is disposed on plate 62 forward of female member 58, while in the latter button 88 is mounted on plate 84 immediately above female member 58. Both embodiments, however, function identically.

Figure 7:
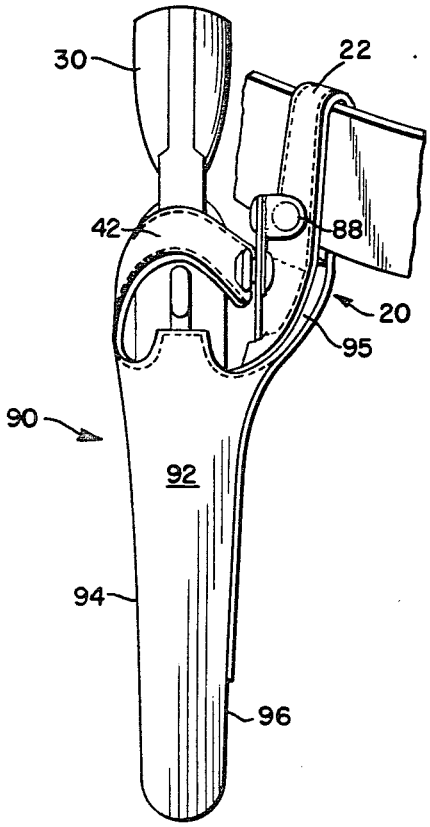
FIG. 7 is a front view of the holster of this invention similar to FIG. 3 illustrating another embodiment of the actuator.
Figure 8:
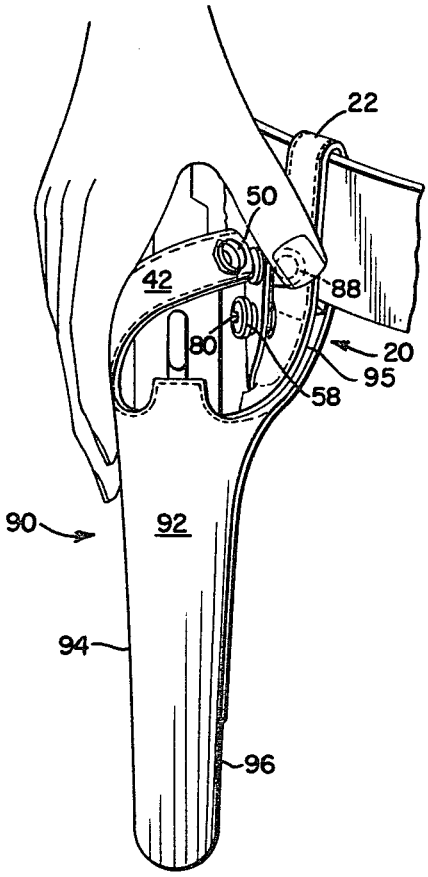
FIG. 8 is a view similar to FIG. 7 illustrating the actuation movement to open the snap fastener members.

Similarly holster 90 of FIGS. 7 and 8 consists of a pocket member 92 having integral outer and inner surfaces 94 and 96 joined by stitching at common rear edges (not shown) similar to 36 by FIGS. 2A–4.

With attention to FIG. 3 and FIGS. 7 and 8, engagement or disengagement of snap fasteners 50 and 58 by a front-to-rear and rear-to-front movement of the wearers thumb requires that pocket 18 or 92 be displaced outwardly from the wearers belt and belt loop 22 on member 20. Displacement is accomplished by an angled brace member 95 preferably inserted within member 20 between the outer and inner portions thereof. Displacement brace 95 then functions with actuator button 60 or 88 to permit concealment thereof between the handgun 30 and belt loop 22 and to permit front-to-rear movement thereof for unimpedeed release of strap 42 and withdrawal of handgun 30 from holster 10 or 90.

The invention may be embodied in other specific forms without departing from the spirit or central characteristics thereof. The present embodiment is, therefore, to be considered in all respects as illustrative and not restrictive, the scope of the invention being indicated by the appended claims rather than by the foregoing description, and all changes which come within the meaning and range of equivalency of the claims are, therefore, intended to be embraced herein.

What is to be claimed:

1. In an upwardly opening holster for holding a handgun including a pocket for receiving said handgun having an exposed side portion and a backside portion, a belt receiving member having an upper portion defining a belt loop for receiving a belt to hold said holster about the waist of a user and a lower portion attached to said backside portion, said pocket further having front and rear portions connecting said exposed side and backside portions and an open top portion for receiving the handgun, the improvement comprising:

means carried by said holster for displacing said pocket outwardly from said belt loop so that when the handgun is received in said pocket the handle thereof will be spaced away from the upper portion of said belt receiving member;

a safety strap extending from the top portion of the exposed side portion of the pocket, said strap configured to extend over a handgun when the handgun is received in said pocket, and a first part of a snap fastener mounted on the distal portion of said strap;

a complementary strap formed of a semirigid material having a lower end mounted on the backside portion and a second part of a snap fastener mounted on the distal portion of said strap whereby when a handgun is received in said pocket said safety strap will extend thereover so that the parts of said snap fastener may be fastened to retain said handgun in said pocket, and said fastener will be located between said handgun and the belt receiving member;

means carried by the second part of the snap fastener for permitting disengagement of said first and second parts only reponsive to movement of the second part from the front toward the rear of said holster;

a concealed rigid button member mounted on the distal portion of said complementary strap adjacent the second part of said snap fastener and extending substantially transversely between the belt receiving member and the handgun when the handgun is received in said pocket for unfastening the second and first parts of said fastener responsive to pressure thereon by the thumb of the user directed from the front to the rear of said pocket so that the user of said holster may release the handgun as the handgun is withdrawn from the pocket, said button member being concealed between the handgun and the belt receiving member so that said fastener can not readily be unfastened except by the user.

2. The holster of claim 1 wherein said complementary strap is formed of polyurethane.

3. The holster of claim 1 wherein the first part of said snap fastener is the male part and the second part of said snap fastener is the female part.

4. The holster of claim 3 wherein said female part further comprises an inner, male part receiving rim and said means for permitting disengagement comprises a lip mounted on said rim at the rear thereof.

* * * * *